United States Patent [19]

Ito et al.

[11] Patent Number: 4,550,373

[45] Date of Patent: Oct. 29, 1985

[54] TEMPERATURE-FEEDBACK ELECTRONIC ENGINE CONTROL APPARATUS AND METHOD

[75] Inventors: Toshimitsu Ito, Toyota; Toshiaki Isobe, Nagoya; Takashi Hattori, Toyota, all of Japan

[73] Assignee: Toyota Jidosha Kogyo Kabushiki Kaisha, Toyota, Japan

[21] Appl. No.: 403,043

[22] Filed: Jul. 29, 1982

[30] Foreign Application Priority Data

Feb. 19, 1982 [JP] Japan ..... 57-24347

[51] Int. Cl.[4] ..... F02D 5/02; F02D 33/00; F02M 51/00; F02N 11/14

[52] U.S. Cl. ..... 364/431.04; 123/179 L; 123/179 G; 123/491

[58] Field of Search ..... 123/424, 425, 480, 489, 123/491, 179 G, 179 L; 364/179, 431

[56] References Cited

U.S. PATENT DOCUMENTS 4,306,529 12/1981 Chiesa et al. ..... 123/440
4,308,585 12/1981 Jordan ..... 364/179 X
4,360,874 11/1982 Ohba et al. ..... 364/431.04
4,389,996 6/1983 Yaegashi et al. ..... 123/491

*Primary Examiner*—Errol A. Krass
*Assistant Examiner*—Donna Angotti
*Attorney, Agent, or Firm*—Cushman, Darby & Cushman

[57] ABSTRACT

An electronic engine control apparatus and method for computing various engine operating parameters such as fuel injection amount on the basis of input signals from a temperature sensor which detects engine temperature, wherein the signals from the temperature sensor are read more frequently before the complete explosion (i.e., running without a starter motor) of the engine than after attainment of complete explosion (i.e., after a start period) so that degradation of accuracy in the computed fuel injection amount, due to variation of the input signals from the temperature sensor which is caused by the starting motor, is reduced.

6 Claims, 5 Drawing Figures

TEMPERATURE-FEEDBACK ELECTRONIC ENGINE CONTROL APPARATUS AND METHOD

BACKGROUND OF THE INVENTION

1. Field of the Invention:

This invention relates to a control system for electronic engine control for computing various controlled variables by a digital processor, and more particularly to a system of reading the input signal from a temperature sensor which detects the engine temperature.

2. Description of the Prior Art:

The input signal from a water temperature sensor for detecting cooling water temperature (which is closely related to the engine temperature) is an important factor in computing fuel injection amount during an engine start period and during engine warming-up after the start period. An analog sensor signal may be for example, A-D (Analog-Digital) converted and read at predetermined intervals of time during operation of the engine. In prior control systems for electronically controlled fuel injection engines, frequency of reading the input signal from the water temperature sensor during the start period is equal to that after the start period (in this specification the start period means a period from start and operation of a starting motor to occurrence of complete explosion, and post-start period means a period during which the engine is operated after the complete explosion, complete explosion being self-sustained engine operation not requiring the starting motor operation) and does not vary. The water temperature sensor generally contains a thermistor to which voltage related to voltage of an accumulator is applied. The voltage of the accumulator in the temperature sensor varies (or fluctuates) greatly in the start period because current is supplied to the starting motor, so that the input signal from the water temperature sensor also fluctuates greatly. Thus, prior systems for reading the input signal from the water temperature sensor during the start period were subject to greatly deviating signals due to this accumulator voltage variation so that fuel injection amount, for example, are computed on the basis of that great deviation for a relatively long time until the next reading, causing loss to accuracy in control. However, after the start period the cooling water temperature has relatively small time-based variation compared with other detected parameters, and any reduction in the frequency of reading the cooling water temperature also reduces the frequency of reading other parameters after the start period, which is not advantageous for accuracy in engine control after the start period.

SUMMARY OF THE INVENTION

An object of the present invention is to provide a control system for electronic engine control which reduces the degradation of accuracy in control due to the variation of the output signal of a temperature sensor during the start period without hindrance to reading the object to be detected other than temperature after the start period.

According to the present invention achieving this object, in a control system for electronic engine control for computing the controlled variable object to be controlled by the digital processor on the basis of the input signal from the temperature sensor detecting the engine temperature, the frequency of reading the input signal from the temperature sensor before the complete explosion of the engine (i.e., during starter motor operation) is higher than that after the complete explosion of the engine (i.e., after conclusion of the starter motor operation).

Thus, since the input signal from the temperature sensor is frequently read during the start period when the input signal from the temperature sensor greatly varies, the higher sampling rate reduces degradation of accuracy in control due to the variation of the input (i.e., temperature feedback signal).

The temperature sensor is generally a water temperature sensor for determining the engine temperature from the temperature of the engine cooling water.

An object to be controlled may be, for example, an electromagnetic fuel injection valve system for supplying fuel to an intake system and controlling opening time of the electromagnetic system fuel injection valve, i.e. fuel injection amount control, as computted in relation to the determined engine temperature.

In a preferred embodiment of the present invention, priority of reading the input signal from the temperature sensor before the complete explosion of the engine is higher than that after the complete explosion of the engine.

In the preferred embodiment, a schedule for determining the sequence of reading inputs from various sensors before the complete explosion is different from that after the complete explosion.

In the further preferred embodiment, the number of indications for reading the input signal from the temperature sensor contained in the schedule before the complete explosion is greater than that after the complete explosion, meaning that such indications are more "densely packed" prior to complete explosion than after.

DESCRIPTION OF THE PREFERRED EMBODIMENTS

The embodiments of the present invention will be described with reference to the drawings.

Figure 1:
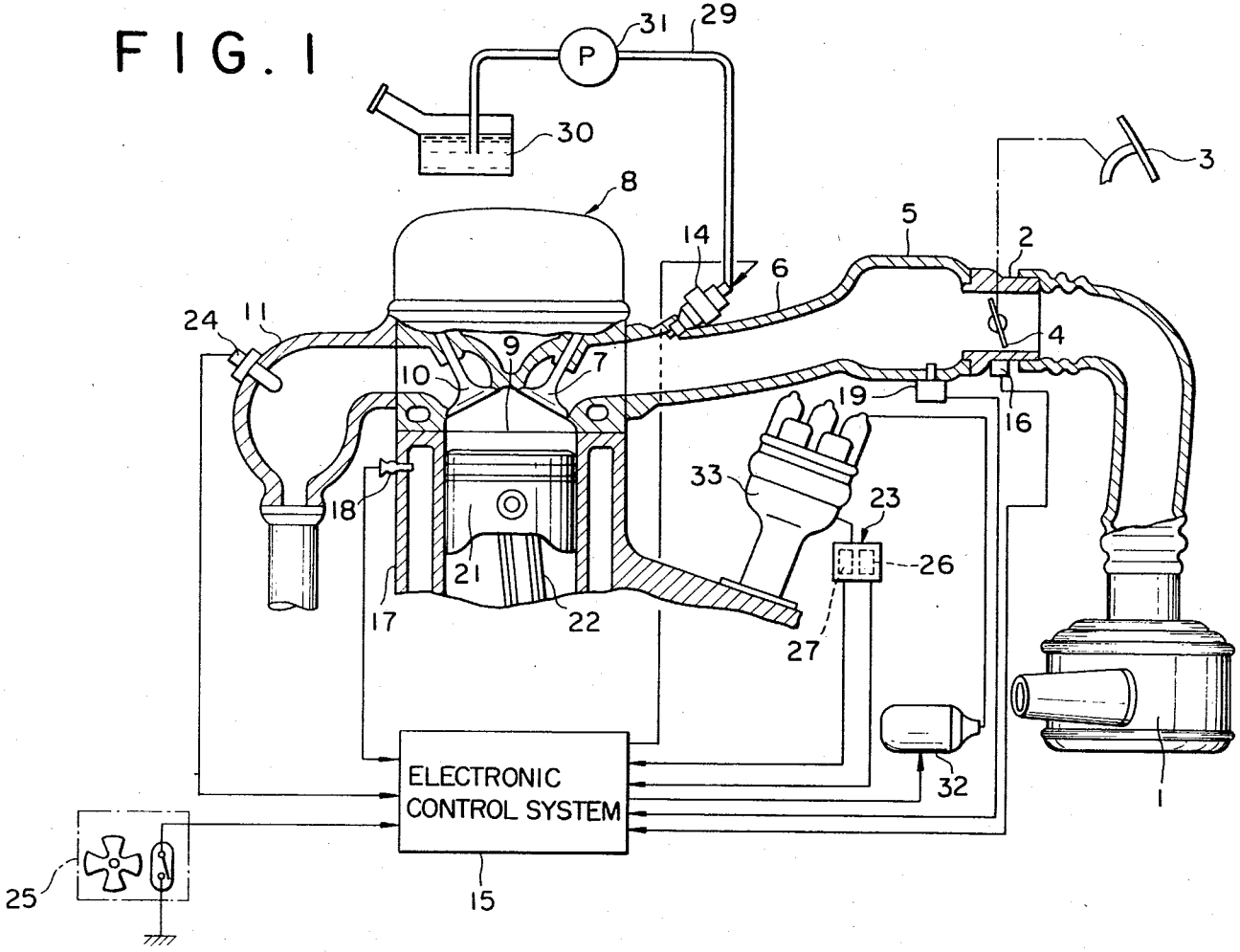
FIG. 1 is a schematic illustration of an electronically controlled engine according to the present invention.

Referring to FIG. 1 showing generally the whole electronic control fuel injection engine according to the present invention, air flow sucked from an air cleaner 1 is controlled by a throttle valve 4 provided in a throttle body 2 and interlocked with an accelerator pedal 3 inside a vehicle. The air flow is then supplied to a combustion chamber 9 in an engine body 8 through a surge tank 5, intake pipe 6 and intake valve 7. Mixture burnt in the combustion chamber 9 is discharged as exhaust gas through an exhaust valve 10 and exhaust manifold 11. An electromagnetic fuel injection valve 14 is provided in the intake pipe 6 corresponding to each combustion chamber 9. An electronic control system 15 may receive input signals from a throttle switch 16 for detecting full closing of the throttle valve 2, a water temperature sensor 18 mounted on a water jacket 17 of the engine body 8, a pressure sensor 19 provided in the surging tank 5 to detect intake pipe pressure related to the intake air flow rate, a crank angle sensor 23 for detecting rotational angle of a distributor shaft coupled to a crank shaft to detect rotational angle of the crank shaft coupled to pistons 21 through connecting rods 22, an air fuel ratio sensor 24 provided in the exhaust manifold 11 to detect oxygen concentration in exhaust gas, and a vehicle speed sensor 25. The rotational angle sensor 23 is provided with one portion 26 for producing one pulse for two rotations of the crank shaft and another portion 27 for producing one pulse for every predetermined crank angle, for example, 30°. Fuel is forcibly sent from a fuel tank 30 through a fuel path 29 to the fuel injection valve 14 by a fuel pump 31.

The electronic system 15 computes fuel injection amount and fuel injection period on the basis of various input signals so as to send fuel injection pulses to the fuel injection valve 14 while computing ignition timing to send ignition signals to ignition coil 32. The secondary current in the ignition coil 32 is sent to a distributor 33. Further, the injection valve 14 is maintained in an opened condition only when it receives pulses from the electronic control system 15.

Figure 2:
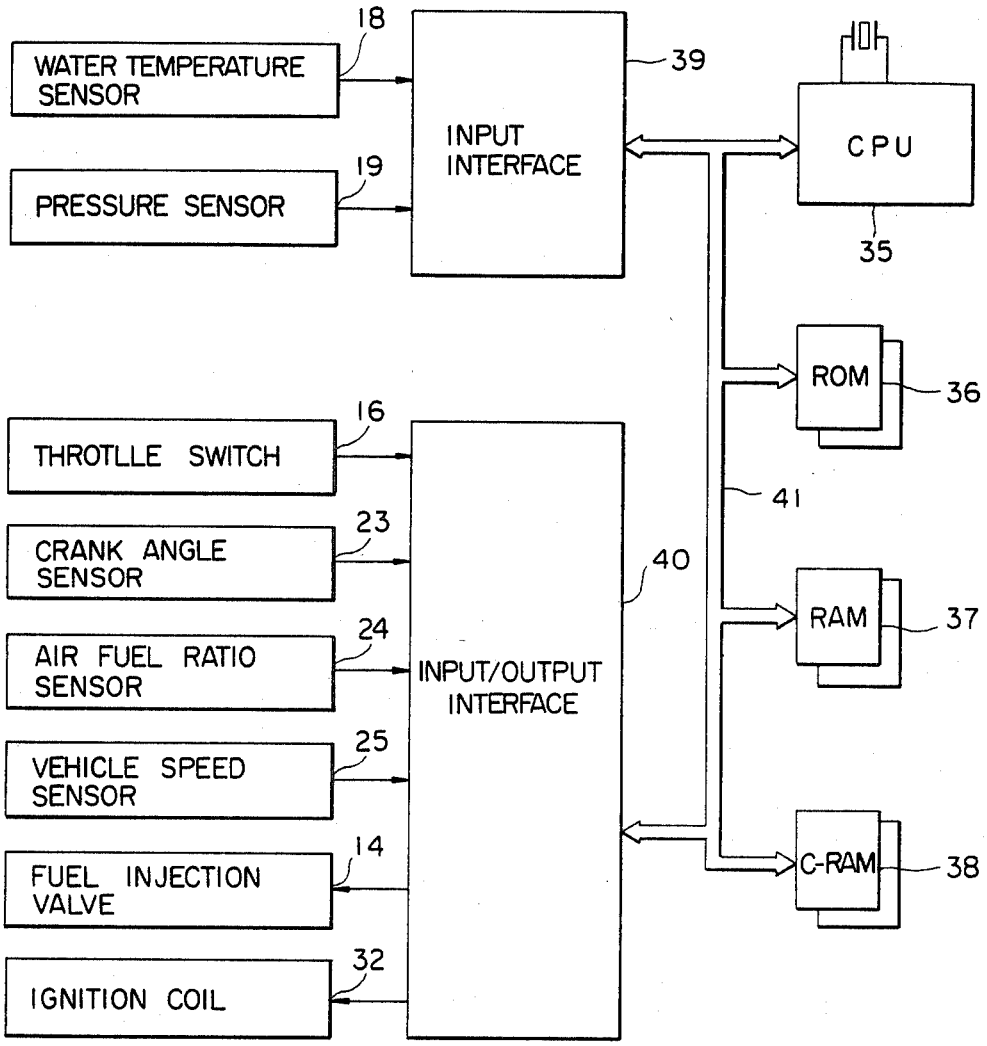
FIG. 2 is a block diagram of the FIG. 1 illustration.

FIG. 2 is a block diagram of the interior of the electronic control system 15. CPU (Central Processing Unit) 35 as a digital processor, ROM (Read-Only Memory) 36, RAM (Random Access Memory) 37, C-RAMs (Complement type RAM) 38, input interface 39 and input/output interface 40 are all connected to each other through bus 41. One C-RAM 38 can be supplied with predetermined power so as to hold memory even during stoppage of the engine. The input interface 39 has a built-in A/D (Analog/Digital) converter, and analog outputs of the water temperature sensor 18 and pressure sensor 19 are sent to the input interface 39. The outputs of the throttle switch 16, crank angle sensor 23, air fuel ratio sensor 24 and vehicle speed sensor 25 are sent to the input/output interface 40, and electric signals to the fuel injection valve 14 and ignition coil 32 are sent from the input/output interface 40.

Figure 3:
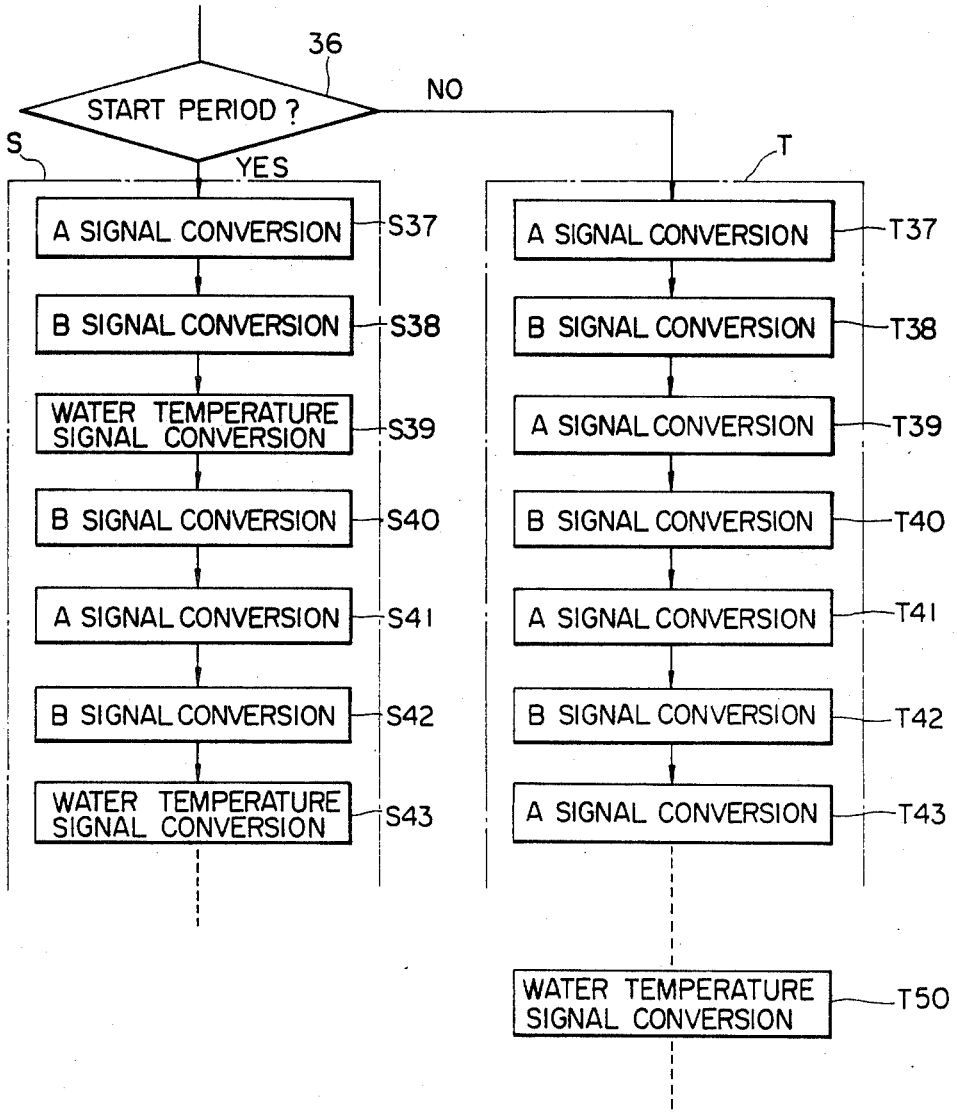
FIG. 3 is a drawing showing the sequence of reading input signals during and after the start period.

FIG. 3 shows the sequence of A/D conversion in the input interface 39, i.e., the sequence of reading the input signals. In FIG. 3, the input signals are assumed to be of three types, A, B and water temperature. Step 36 determining whether it is the start period, and if so judged the sequences of A/D conversion of the input signals is selected, and if it is judged to be after the start period the sequence T of A/D conversion of the input signal is selected. Step 36 may be based on, for example, the time taken for rotation of a predetermined angle of the engine crank shaft. When the complete explosion is produced (i.e., after the start period) the required time for the predetermined rotation is less than a predetermined value. The sequence S A/D conversions are signal A (step S 37), signal B (step S38), water temperature signal (step S39), signal B (step S40), signal A (step S41), signal B (step S42), water temperature signal (step S43), . . . in that order. The sequence T steps are signal A (step T37), signal B (step T38), signal A (step T39), signal B (step T40), signal A (step T41), signal B (step T42), signal A (step T43), . . . water temperature signal (step T50), . . . in that order. The frequency of A/D conversion of the water temperature signal (i.e., frequency of reading water temperature during the start period) is selected higher than that after the start period.

Figure 4:
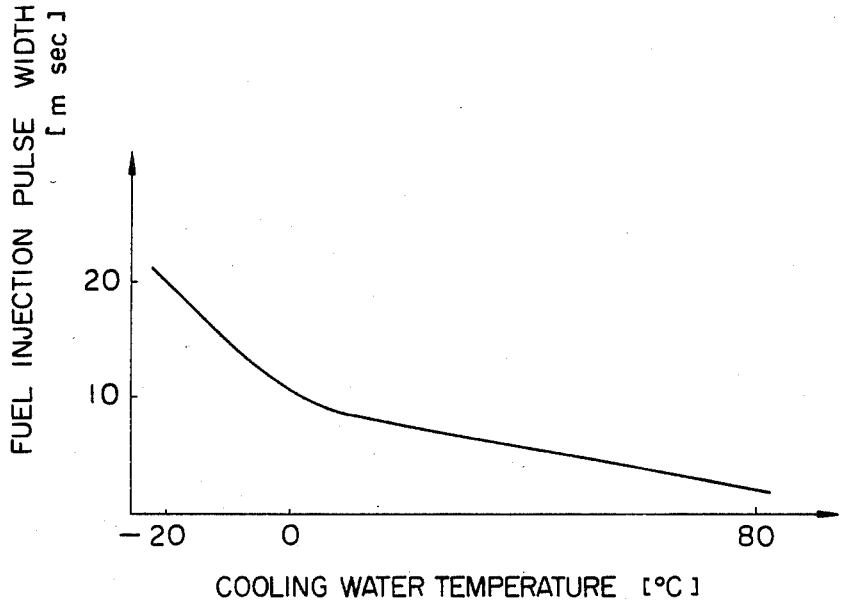
FIG. 4 is a drawing showing the relationship between cooling water temperature and fuel injection pulse width.
Figure 5:
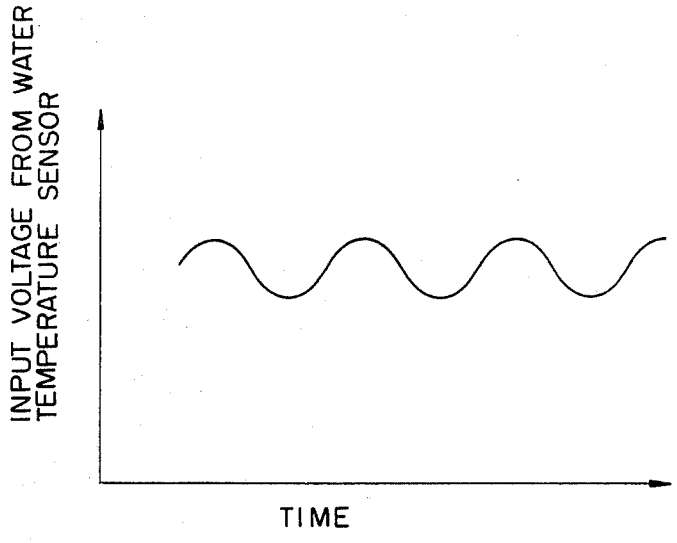
FIG. 5 is a drawing showing exemplary time-based variation of input voltage from a water temperature sensor during the start period.

FIG. 4 shows the relationship between cooling water temperature and pulse width of fuel injection (i.e., input pulse width of the electromagnetic system fuel injection valve 14) during the start period. The fuel injection pulse width is a function of cooling water temperature. FIG. 5 shows time-based variation of input voltage from the water temperature sensor 18 during the start period. During the start period, voltage of the accumulator is varied by operation of the starting motor so that the input voltage from the water temperature sensor 18 is also greatly varied. Hence, when the frequency of reading the input from the water temperature sensor 18 is small relative to a large input deviation per time reading, difficulties are encountered in computing a controlled variable, for example, fuel injection pulse width shown in FIG. 4. Since the frequency of reading during the start period according to the present invention is large, the changing input can be read immediately. Even though the input greatly deviates, the previous difficulties in computing the controlled variable can be remarkably reduced. Since the voltage variation of the accumulator is slight after the start period and the time-based variation of water temperature is small compared with that of the other objects to be detected, the frequency of reading the input from the water temperature sensor 18 is reduced after the start period, as shown by T in FIG. 3.

It is assumed, for example, that the time intervals between reading the inputs from the water temperature sensor 18 during the start period are 20 m sec. and the time intervals between readings of the input from the water temperature sensor 18 after the start period is 1 sec.

In a first embodiment where the frequency of reading the cooling water temperature during the start period differs from that after the start period, the priority of reading the cooling water temperature before the complete explosion may also differ from that after the complete explosion. For example, the priority of reading the cooling water temperature after the start period is lower than the priority of the other detecting amounts, and the priority of reading the cooling water temperature during the start period is higher than the reading priority for the other detections. Further, in a second embodiment, two schedules for determining the sequence of reading the inputs from various sensors are provided for the start period and the post-start period, and the number of reading of the cooling water temperature in the schedule table for the start period is higher than for the post-start period schedule.

Thus, according to the present invention, the frequency of reading the input signal from the temperature sensor during the start period is higher than that after the start period, so that the input read from the temperature sensor when the input greatly deviates during the start period affects such input only for a very short period to thereby improve the accuracy in controlling the electronically controlled engine.

What is claimed is:

1. An electronic control system for an internal combustion engine comprising:

means for detecting a start period for said engine defined by operation of a starting motor adapted to start said engine;

means for detecting a complete explosion operation of said engine defined by the occurrence of self-sustained combustion in said engine without operation of said starting motor;

sampling means for sampling at least two engine operating parameters, including at least the engine temperature, at a determined sampling rate and in a specified sequence;

control means for controlling at least the air-fuel ratio of said engine in response to said sampled parameters; and means, responsive to said start period and complete explosion detecting means, for establishing said determined sampling rate at a higher frequency during said start period than during said complete explosion operation so as to more closely monitor said engine temperature parameter during said start period because of increased sampling fluctuations induced by said operation of said starting motor, even though said engine temperature parameter remains nearly constant during said start period.

2. A system as in claim 1 wherein said sampled engine temperature is the temperature of cooling water associated with said engine.

3. A system as in claim 1, further comprising: means, responsive to said start period and complete explosion detecting means, for specifying said sampling sequence such that sampling of said engine temperature is a higher priority sampling during a detected start period than during a detected complete explosion operation.

4. A system as in claim 3 wherein said specifying means further includes means for modifying the relative sampling priorities of all of said sampled parameters in accordance with the detections of said start period and complete explosion operation detecting means.

5. A method of electrically controlling an engine comprising the steps of:

detecting the operation of a starting motor adapted to start said engine;

detecting self-sustained combustion operation of said engine without operation of said starting motor;

sampling the engine temperature at a determined sampling rate; and determining said sampling rate such that it is higher during operation of said starting motor than during said self-sustained combustion operation to compensate for increased sampling fluctions induced by operation of said starting motor which occur even though said engine temperature remains nearly constant during operation of said starting motor.

6. A method as in claim 5, further including the steps of:

sampling additional engine parameters other than engine temperature; and establishing a sampling priority sequence for said parameters and said engine temperature which varies in accordance with determinations of said detecting steps so as to place engine temperature sampling at a higher priority relative the other sampled parameters during starting motor operation than during self-sustained engine combustion operation.

* * * * *